US011851303B2

(12) United States Patent
O'Keefe et al.

(10) Patent No.: US 11,851,303 B2
(45) Date of Patent: Dec. 26, 2023

(54) ELEVATING CAGE APPARATUS WITH ALTERNATIVE POWERED OR MANUAL INPUT

(71) Applicant: Safe Rack LLC, Andrews, SC (US)

(72) Inventors: James Michael O'Keefe, Columbia, SC (US); Jeffrey David Scott, Cornelius, NC (US)

(73) Assignee: SAFE RACK LLC, Andrews, SC (US)

( * ) Notice: Subject to any disclaimer, the term of this patent is extended or adjusted under 35 U.S.C. 154(b) by 270 days.

(21) Appl. No.: 16/031,468

(22) Filed: Jul. 10, 2018

(65) Prior Publication Data

US 2019/0016563 A1 Jan. 17, 2019

Related U.S. Application Data

(60) Provisional application No. 62/531,612, filed on Jul. 12, 2017.

(51) Int. Cl.
*B66B 5/16* (2006.01)
*B66B 11/02* (2006.01)
(Continued)

(52) U.S. Cl.
CPC ..... *B66B 11/0226* (2013.01); *B66B 9/02* (2013.01); *B66B 11/0415* (2013.01);
(Continued)

(58) Field of Classification Search
CPC ..... B66B 11/0226; B66B 11/0415; B66B 11/0469; B66B 11/04; B66B 11/0446; B66B 9/02
(Continued)

(56) References Cited

U.S. PATENT DOCUMENTS 670,466 A * 3/1901 Bolander ..... B66B 11/0469 187/255
1,000,953 A * 8/1911 Schwarz ..... B66B 11/0415 187/405
(Continued)

FOREIGN PATENT DOCUMENTS

EP 3219656 A1 * 9/2017 ..... B66B 7/00
EP 3318520 A1 * 5/2018 ..... B65B 41/14
(Continued)

OTHER PUBLICATIONS

Co-pending U.S. Appl. No. 15/987,659, filed May 23, 2018, all enclosed pages cited.
(Continued)

*Primary Examiner* — Jerry E Redman
(74) *Attorney, Agent, or Firm* — Nelson Mullins Riley & Scarborough LLP

(57) ABSTRACT

An elevating cage apparatus includes a support structure and a carriage that is operable to move vertically with respect to the support structure. The carriage is configured to be alternatively raised and lowered via a first driver and a second driver. The first driver may comprise a powered (electric, hydraulic, or pneumatic) motor, and the second driver may comprise a manual actuation mechanism including a hand crank. Both input drivers may be operable to move the carriage through a dual input worm drive gear box.

17 Claims, 10 Drawing Sheets

(51) Int. Cl.
*B66F 11/04* (2006.01)
*B66B 11/04* (2006.01)
*B66B 9/02* (2006.01)

(52) U.S. Cl.
CPC ..... *B66B 11/0469* (2013.01); *B66F 11/04* (2013.01); *B66B 11/0446* (2013.01)

(58) Field of Classification Search
USPC ..... 49/139, 49
See application file for complete search history.

(56) References Cited

U.S. PATENT DOCUMENTS 1,545,053 A * 7/1925 Kelly ..... B61L 29/04 49/9
1,564,536 A * 12/1925 Davis ..... B66B 9/02 187/267
1,901,279 A * 3/1933 Baldwin ..... B66B 11/0469 187/255
1,923,034 A * 8/1933 Henricksen ..... B66B 11/0469 187/255
2,189,974 A * 2/1940 Buford ..... B61L 29/023 49/9
2,435,122 A * 1/1948 Berndt ..... F16H 15/18 74/400
3,140,559 A * 7/1964 Grow ..... A47B 27/06 108/6
4,040,307 A * 8/1977 Koster ..... F16H 1/16 74/425
4,419,039 A * 12/1983 Bengtsson ..... B65G 61/00 414/225.01
4,472,910 A * 9/1984 Iha ..... E05F 15/668 74/625
4,493,479 A * 1/1985 Clark ..... B66D 1/58 188/134
4,534,476 A * 8/1985 Burchfield ..... B66D 1/60 212/307
4,664,230 A * 5/1987 Olsen ..... B66B 11/0045 187/255
4,742,891 A * 5/1988 Kunii ..... B66B 9/025 187/267
4,756,657 A * 7/1988 Kinney ..... B65G 1/0435 414/280
5,044,473 A * 9/1991 Gripe ..... E04G 1/20 187/244
5,408,940 A * 4/1995 Winchell ..... A47B 9/06 108/10
5,605,071 A * 2/1997 Buchanan, Jr. ..... F16H 1/16 188/134
6,062,148 A * 5/2000 Hodge ..... A47B 9/02 108/147
6,062,403 A * 5/2000 Baumann ..... B66C 13/54 212/291
6,676,233 B1 * 1/2004 Evans ..... B66B 9/02 312/247
6,724,302 B2 * 4/2004 Parsadayan ..... E05F 15/643 340/552
6,739,372 B2 * 5/2004 Mullet ..... E05F 15/603 74/625
7,086,632 B2 * 8/2006 Hsieh ..... G10H 1/32 108/147
7,358,480 B2 * 4/2008 Mullet ..... E05F 15/603 250/231.13
7,481,133 B2 * 1/2009 Walravens ..... E05F 15/603 49/140
7,721,616 B2 * 5/2010 Augustine ..... F16H 55/24 74/425
7,818,920 B2 * 10/2010 Causey ..... E01F 13/06 49/49
8,182,381 B2 * 5/2012 Gunton ..... E06B 9/70 160/310
8,381,442 B2 * 2/2013 Wan ..... E05F 15/603 49/140
8,616,080 B2 * 12/2013 Flatt ..... F16H 25/2021 244/99.2
9,341,022 B2 * 5/2016 Nicholson ..... E05F 15/684
9,409,755 B2 8/2016 Melton et al.
9,457,988 B1 * 10/2016 Anderson ..... F16H 25/2003
9,879,759 B1 * 1/2018 Mauro ..... F16H 55/22
10,000,960 B2 * 6/2018 Angiuli ..... E05F 15/40
10,087,641 B2 10/2018 Harmon
10,159,336 B2 * 12/2018 Liao ..... A47B 9/16
10,281,435 B2 * 5/2019 Yu ..... B66B 7/047
10,634,217 B2 * 4/2020 Figura ..... F16H 55/24
2004/0021292 A1 * 2/2004 Abair ..... B60D 1/40 280/456.1
2004/0154870 A1 * 8/2004 Bass ..... B66B 7/022 187/270
2006/0151255 A1 * 7/2006 Payne ..... B66B 7/066 187/351
2006/0169082 A1 * 8/2006 Clark ..... F16H 1/16 74/421 A
2007/0125193 A1 * 6/2007 Augustine ..... F16F 15/022 74/416
2008/0025828 A1 * 1/2008 Strasssman ..... B60P 1/4421 414/462
2008/0041178 A1 * 2/2008 Ozsoylu ..... F16H 55/24 74/425
2010/0119338 A1 * 5/2010 Webster ..... E04H 6/18 414/239
2011/0038726 A1 * 2/2011 Elkin ..... F03D 7/0224 416/131
2011/0127742 A1 * 6/2011 Bae ..... F16H 25/24 280/93.513
2011/0271443 A1 * 11/2011 Serhan ..... A47C 19/045 5/11
2012/0279806 A1 * 11/2012 Webster ..... B66B 1/06 187/289
2013/0333846 A1 * 12/2013 Albrecht ..... E04F 10/0614 160/66
2014/0209415 A1 * 7/2014 Hall ..... H02J 9/062 187/290
2014/0251730 A1 9/2014 Bisset
2015/0034418 A1 * 2/2015 Melton ..... B66F 17/006 182/113
2016/0047205 A1 * 2/2016 Head ..... E21B 4/006 166/66.4
2016/0121921 A1 * 5/2016 Schönlechner ..... B62D 5/0403 180/444
2016/0214835 A1 * 7/2016 Jin ..... B66B 9/025
2016/0362284 A1 * 12/2016 Haessler ..... E04G 1/18
2016/0362859 A1 * 12/2016 Schaedler ..... E01H 5/09
2016/0368737 A1 * 12/2016 Webster ..... B66B 11/0469

FOREIGN PATENT DOCUMENTS

GB 2294253 A * 4/1996 ..... B66B 11/0469
WO WO-2005045135 A1 * 5/2005 ..... E01F 13/048
WO WO-2006059380 A1 * 6/2006 ..... B65D 5/606

OTHER PUBLICATIONS

Office Action dated Sep. 14, 2023 in corresponding Canadian patent application 3,011,046.

* cited by examiner

ELEVATING CAGE APPARATUS WITH ALTERNATIVE POWERED OR MANUAL INPUT

PRIORITY CLAIM

This application is based upon and claims the benefit of provisional application Ser. No. 62/531,612, filed Jul. 12, 2017, which is incorporated herein by reference in its entirety for all purposes.

FIELD OF THE INVENTION

The present invention generally relates to elevating cages used in conjunction with shipping containers. In particular, example embodiments of the present invention provide elevating cages that are selectively actuatable with either a powered motor or a manual input using a shared gear assembly.

BACKGROUND OF THE INVENTION

An elevating cage apparatus includes a support structure and a cage structure, or carriage, that moves vertically with respect to the support structure. The carriage includes a railing structure that typically corresponds to the periphery of the top of a shipping container such as a trailer or railcar. The railing structure thus defines an enclosed working area above the container for loading, unloading, or the like. To provide access to a top of the shipping container, the carriage is raised above the height of the shipping container so that the container may be positioned beneath the carriage. Once the container is in position, the carriage is lowered down to a height at which the top portion of the container is accessible.

Such elevating cages generally use powered motors that receive power from a power grid to raise and lower the carriage. In the event of a power failure, the carriage may be unmovable from an elevated position until power returns to the motor. Similarly, the carriage may be unmovable from an elevated position if the motor fails.

SUMMARY OF THE INVENTION

Some example embodiments enable the provision of a novel elevating cage apparatus. According to one aspect of the invention, the elevating cage apparatus includes a support structure (e.g., a support frame). A carriage is raisable and lowerable with respect to the support structure. The carriage is configured to be alternatively raised and lowered by a motor and/or a manual actuation mechanism using a shared gear assembly.

A further aspect of the present invention provides an elevating cage apparatus for use in conjunction with a shipping container. The apparatus comprises a support structure and a carriage coupled to the support structure so that the carriage is movable vertically with respect to the support structure when the support structure is in an upright position. A first drive mechanism and a second drive mechanism are each operative to raise and lower the carriage. Preferably, a shared gear assembly is provided to which the first drive mechanism and the second drive mechanism are operatively connected to raise and lower the carriage.

According to some exemplary embodiments, the shared gear assembly comprises a gear box having a first input and a second input, the first input and the second input operative to drive a shared output. The first drive mechanism may comprise a first driver (e.g., an electric motor or a pneumatic motor) in operative engagement with the first input of the gear box. The second drive mechanism may comprise a second driver (e.g., a manual actuation mechanism or a battery-powered auxiliary electric motor) in operative engagement with the second input of the gear box. The shared gear assembly may preferably include a worm drive or otherwise be configured to act as a brake to hold the carriage in place.

Generally, the carriage will be configured to move vertically along tracks extending vertically along the support structure. For example, the carriage may move along the tracks via a plurality of wheeled assemblies. In such embodiments, the carriage may extend from the support structure in a cantilevered configuration. At least one counterweight may be provided that is configured to offset weight of the carriage.

According to a further aspect, the present invention provides an elevating cage apparatus comprising a support structure and a carriage coupled to the support structure so that the carriage is movable vertically with respect to the support structure when the support structure is disposed in an upright position. A gear assembly is also provided, having an output shaft operatively coupled to the carriage so that rotation of the output shaft in one direction raises the carriage with respect to the support structure and rotation of the output shaft in an opposite direction lowers the carriage with respect to the support structure. A first input shaft is in rotationally driving engagement with the output shaft through the gear assembly and a second input shaft is in rotationally driving engagement with the output shaft through the gear assembly. A first driver is in rotationally driving engagement with the first input shaft. A second driver is in rotationally driving engagement with the second input shaft.

A still further aspect of the present invention provides an elevating cage apparatus for use in conjunction with a shipping container. The apparatus comprises a support structure and a carriage coupled to the support structure so that the carriage is movable vertically with respect to the support structure when the support structure is in an upright position. The carriage defines a railing structure about a periphery thereof. A shared gear assembly is provided having a first input shaft, a second input shaft, and a shared output shaft, the first input shaft and the second input shaft each being operative to rotate the shared output shaft. A powered motor is in operative engagement with the first input shaft of the gear assembly. A manual actuation mechanism is in operative engagement with the second input shaft of the gear assembly.

Other aspects of the present invention will be apparent from the discussion below.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
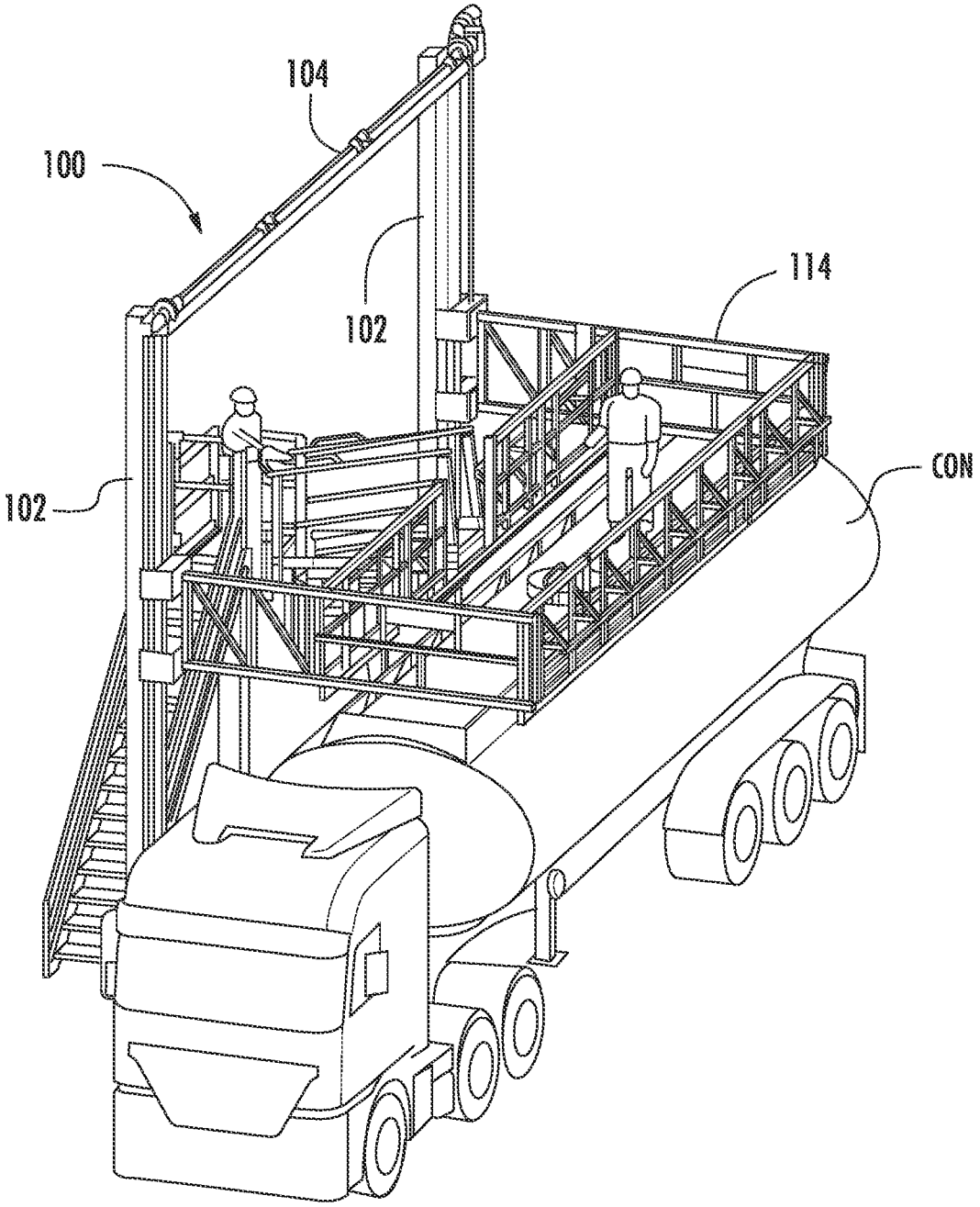
FIG. 1 is an isometric view of an elevating cage apparatus in accordance with an embodiment of the present invention in position with respect to a truck-trailer container.

Repeat use of reference characters in the present specification and drawings is intended to represent same or analogous features or elements of the invention according to the disclosure.

DESCRIPTION OF THE PREFERRED EMBODIMENTS

Some example embodiments now will be described more fully hereinafter with reference to the accompanying drawings, in which some, but not all example embodiments are shown. Indeed, the examples described and pictured herein should not be construed as being limiting as to the scope, applicability, or configuration of the present disclosure. As used herein, "operable coupling" should be understood to relate to direct or indirect connection that, in either case, enables functional interconnection of components that are operably coupled to each other.

Figure 2:
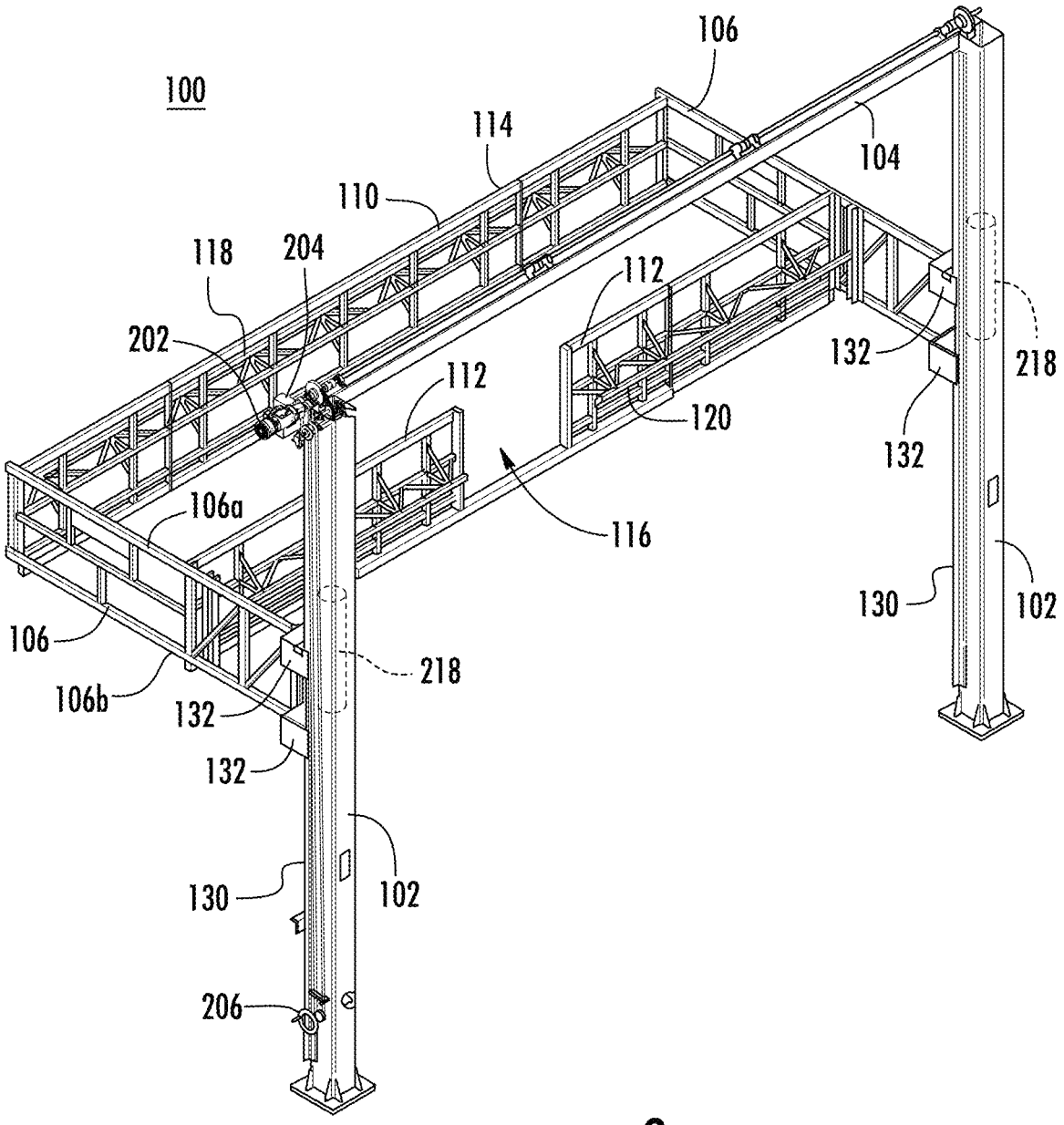
FIG. 2 is a rear isometric view of an elevating cage apparatus in accordance with an embodiment of the present invention.

As used herein, terms referring to a direction or a position relative to the orientation of an elevating cage, such as but not limited to "vertical," "horizontal," "above," or "below," refer to directions and relative positions with respect to the elevating cage's orientation in its normal intended operation, as indicated in FIGS. 1 and 2.

Further, the term "or" as used in this disclosure and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this specification and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

Figure 5:
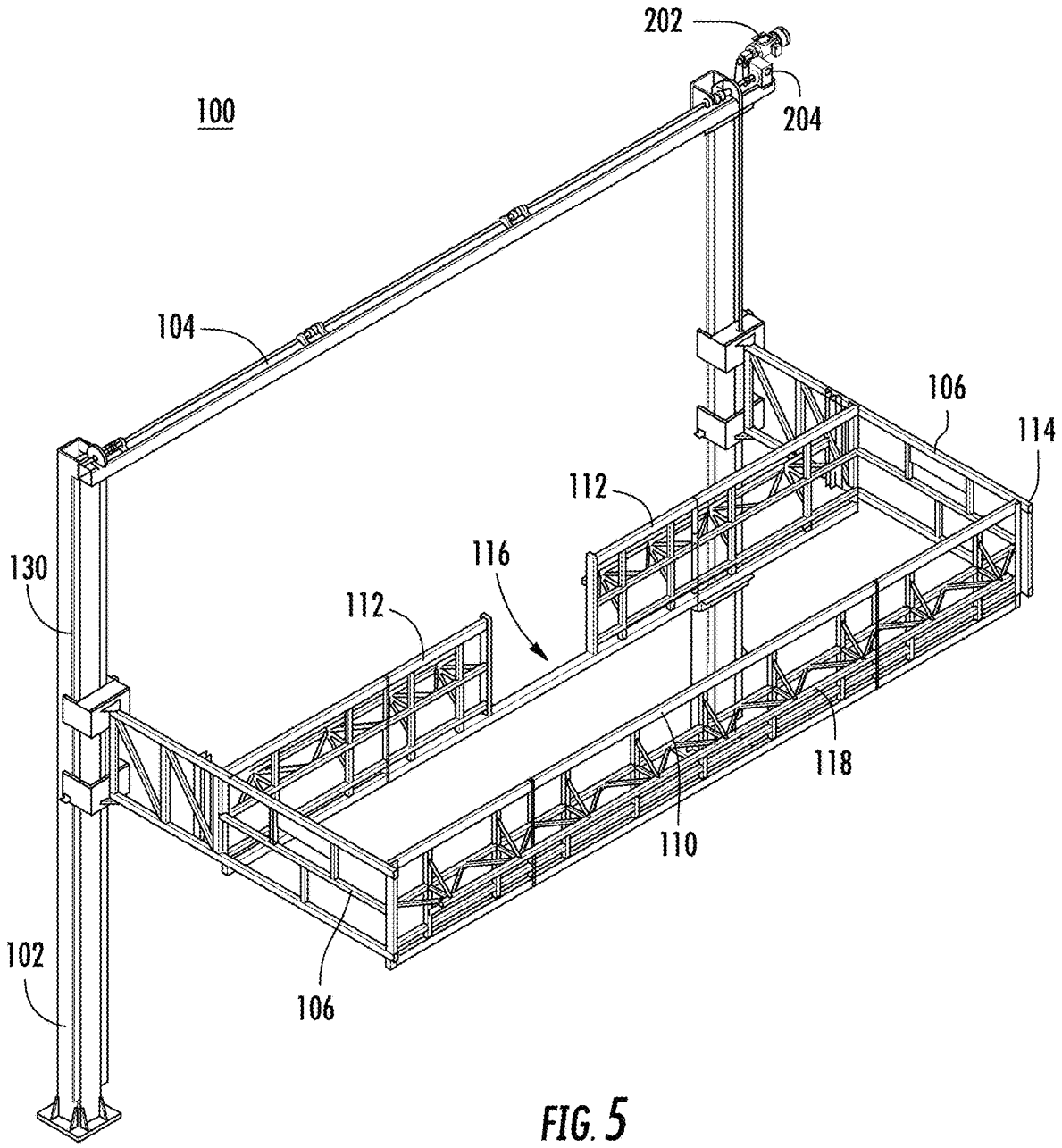
FIG. 5 is a front isometric view of an elevating cage apparatus as in FIG. 2.

FIGS. 1, 2, and 5 illustrate an example embodiment of an elevating cage apparatus 100 including a support structure (e.g., a frame). The support structure includes a pair of hollow vertical columns 102 spaced apart from one another as shown. The bottom ends of columns 102 are fixed with respect to the earth and a cross support member 104 extends between the upper ends of columns 102. Columns 102 are typically attached to a suitable foundation using anchor bolts, which may be precast into the foundation or embedded into existing concrete in accordance with generally accepted engineering practices.

Referring now particularly to FIGS. 2 and 5, a cantilevered side support rail 106 extends horizontally forward from each column 102. Side support rails 106 each include a top member 106*a*, a bottom member 106*b*, and a plurality of structural support members extending therebetween. An outboard rail 110 extends between, and attaches to, distal ends of side rails 106 (with respect to columns 102). A pair of inboard rails 112 extend horizontally from respective side support rails 106 nearer columns 102. This provides a carriage having a generally rectangular cage 114 defined by cantilevered support rails 106 on its sides, outboard rail 110 on a front perimeter, inboard rails 112 on a rear perimeter, and optionally a platform at a bottom (e.g., formed by a plurality of flip-up panels). Rails 112 and rail 110 each include one or more cross-members that define portions of the cage's perimeter.

A lower beam extends between inboard rails 112, thus defining along with rails 112 an opening 116 that provides a worker access to the working area of the cage. In an embodiment, the carriage further includes a door (not shown) hinged to one side of opening 116 so that the door selectively closes off the opening. As shown in FIG. 1, one end of a pivotal gangway may typically be attached at opening 116 so that a worker can walk across to the working area of cage 114 when it is positioned for access to the container CON.

A rail 118 extends along an outside of the cage in the longitudinal direction of the outboard rail and connects via struts extending at about 45 degrees with respect to horizontal from vertical support members of outboard rail 110. A similar rail 120 runs longitudinally along an outside of each of inboard rails 112.

Cantilevered support rails 106 are movable vertically along columns 102. In the illustrated embodiment, a pair of tracks 130 extend along the length of the sides of the respective columns 102. Rails 106 roll along tracks 130 via roller carriage assemblies 132. In an embodiment, roller carriage assemblies 132 include two opposing wheels on each side of tracks 130 (i.e., front and rear sides of the tracks with respect to the front and rear of the elevating cage). In the illustrated embodiment, each cantilevered support rail 106 travels along tracks 130 via four roller carriage assemblies, one at a top and one at a bottom of support rail 106 for each track 130.

Figure 3:
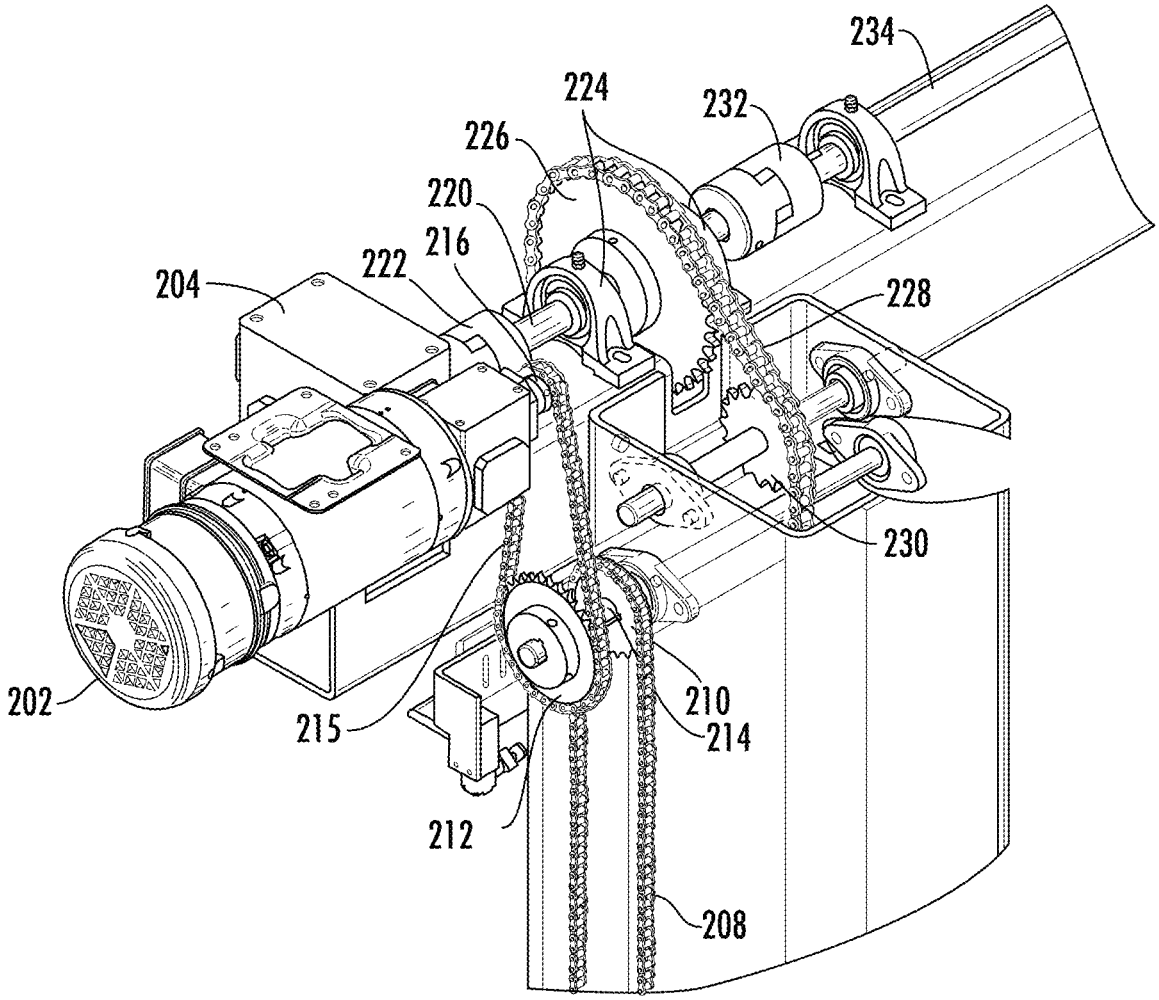
FIG. 3 is an enlarged rear isometric view of a portion of the elevating cage apparatus as in FIG. 2.
Figure 4:
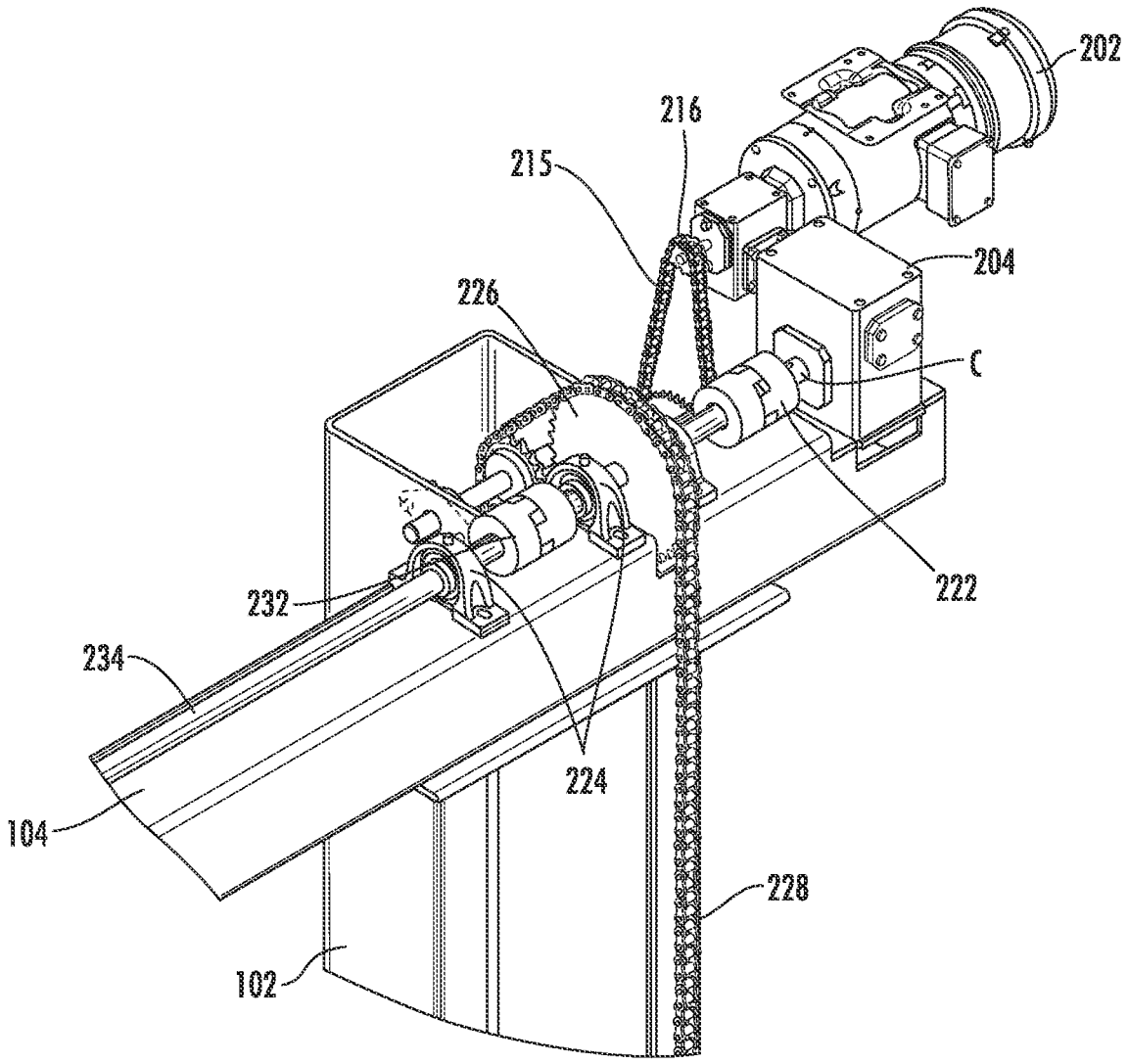
FIG. 4 is an enlarged front isometric view of the portion of the elevating cage apparatus shown in FIG. 3.

FIGS. 3 and 4 illustrate an example embodiment of the mechanisms for operating elevating cage apparatus 100. A powered motor 202 (see also FIG. 11) operatively couples to a gear box 204. As can be most easily seen in FIG. 10, gear box 204 has two portions 204*a* and 204*b* connected together. The two inputs are located at portion 204*a*, as shown. The motor may be electric, hydraulic, or pneumatic and, in an embodiment, is configured to deliver about one horsepower. In this example embodiment, gear box 204 comprises a double input, single output worm gear box, e.g., having a right-angle output. In an embodiment, gear box 204 may have any suitable gear ratio such as a gear ratio of 400:1.

As should be understood, a worm drive serves at least two purposes. First, as the motor drives the worm, the gear box converts a low torque, high speed input into a high torque, low speed output. Therefore, the gear box is particularly suitable in this application of slowly and effectively raising and lowering the carriage. In an embodiment, for example, the motor raises and lowers the cage at a rate of about two inches per minute. A counterweight, discussed below, reduces the motor torque requirements to lift the carriage. Second, because of the inherent design of the worm drive (i.e., due to the lead angle, the pressure angle, and the coefficient of friction), the direction of transmission is effectively not reversible. That is, a load on the output of the gear box will not cause the gears to rotate. Therefore, the weight of the carriage cannot cause the carriage to move. Instead, the carriage is moved by driving an input of the gear box (i.e., via the motor or, as described below, a suitable manual actuation mechanism typically including some form of hand crank). In other words, the worm drive acts as a parking brake, holding the elevating cage assembly in place when the worm drive is not actively being driven at an input.

A double input, single output gear box has two input shafts, each in driving engagement via the internal gears with the same output shaft. The dual input provides the capability for multiple configurations and can be beneficial when spatially arranging the drive input with respect to the output. For example, it may sometimes be preferred to have the input and output on opposite sides of the gear box, while it may be beneficial in other applications to have the input and output on the same side. The provision of alternate inputs (which may be separate shafts or opposite ends of the same shaft) allows the system designer flexibility in locating the gear box within the system structure.

Figure 7:
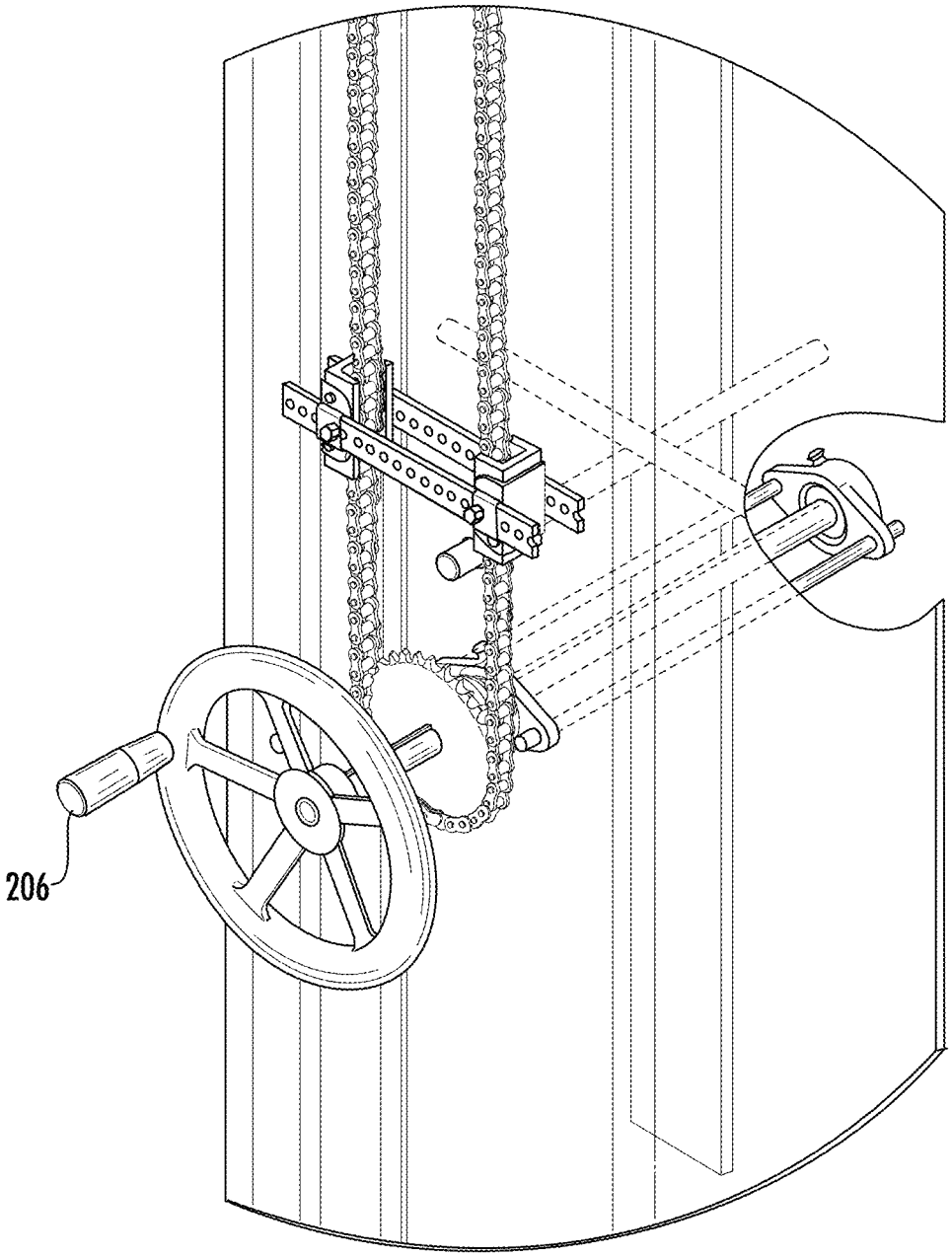
FIG. 7 is an enlarged fragmentary view of a hand crank and associated hardware for use with the elevating cage apparatus as in FIG. 2.

In the elevating cage of the illustrated embodiment, however, each input is operably connected to a separate drive mechanism. In particular, one input is operably connected to the motor 202 and the other input is operably coupled to a hand crank 206 (FIGS. 2 and 7), where the motor and the hand crank are used alternatively to each other. Thus, the output shaft can be driven either by the motor or the hand crank. When the motor drives the gear box, the input shaft connected to the hand crank rotates, as does the output shaft. Thus, hand crank 206 may be contained in a box (e.g., small cage), and the box may be opened or removed in circumstances where the hand crank 206 is needed (e.g., in the case of a power outage that disables the motor). In one example embodiment, hand crank 206 may be in the form of a wheel having a diameter of about sixteen inches.

As shown in FIG. 3, a belt or chain 208 transfers torque provided by the hand crank to a sprocket 210 that, in turn, transfers the torque to a larger sprocket 212 via an interconnecting drive shaft 214. That is, both sprocket 210 and 212 are keyed to drive shaft 214 so that rotation of sprocket 210 causes corresponding rotation of sprocket 212. In turn, sprocket 212 transfers its torque via a chain 215 to a sprocket 216 that is smaller than sprocket 212, and sprocket 216 drives the second input to the gear box opposite the motor input. It should be understood that the relative sizes of the coupled sprockets cause the input torque of the hand crank to be geared down to a lower torque with a higher speed at the second gear box input.

Figure 6:
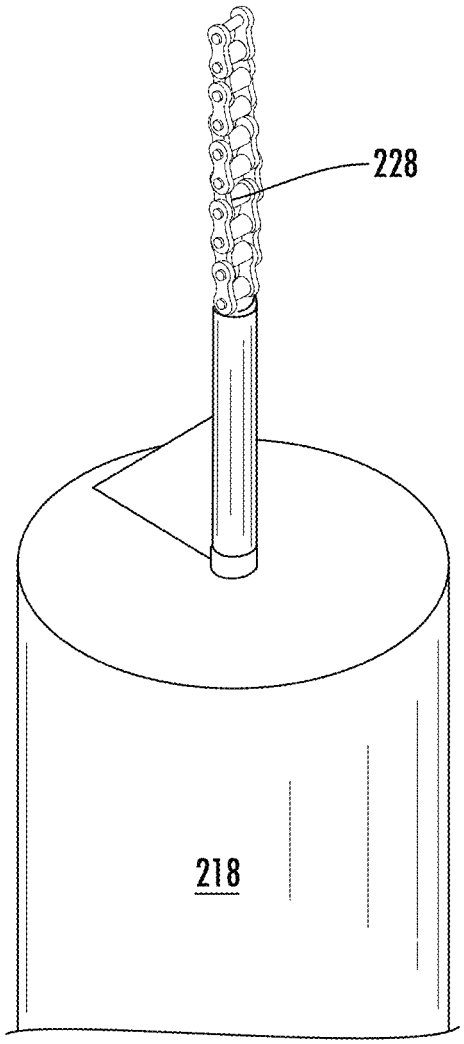
FIG. 6 is a fragmentary view of a counterweight and a portion of an attached chain for use with the elevating cage apparatus as in FIG. 2.

Gear box 204 has an output shaft that outputs its torque to a drive shaft 220 via a coupling 222. Drive shaft 220 rotates in bearings within bearing housings 224 mounted to cross member 104. Further, drive shaft 220 is keyed to a sprocket 226 that drives a chain 228. A first end of chain 228 attaches to the carriage of cage 114 so that rotation of sprocket 226 raises and lowers the carriage. A first counterweight 218 (FIGS. 2 and 6) hangs from a second end of chain 228, opposite the first end, and is suspended within a volume defined by an interior of hollow column 102, thereby offsetting the load of the carriage. An idler sprocket 230 is located between sprocket 226 and the counterweight to direct the path of chain 228.

Figure 8:
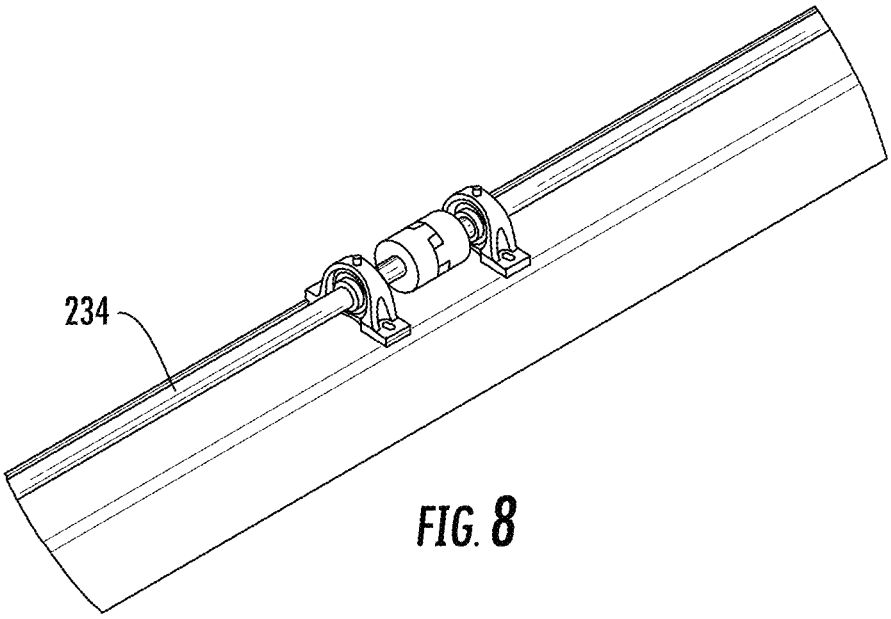
FIG. 8 is a fragmentary view illustrating a drive shaft, a coupling, and a portion of a frame of the elevating cage apparatus as in FIG. 2.
Figure 9:
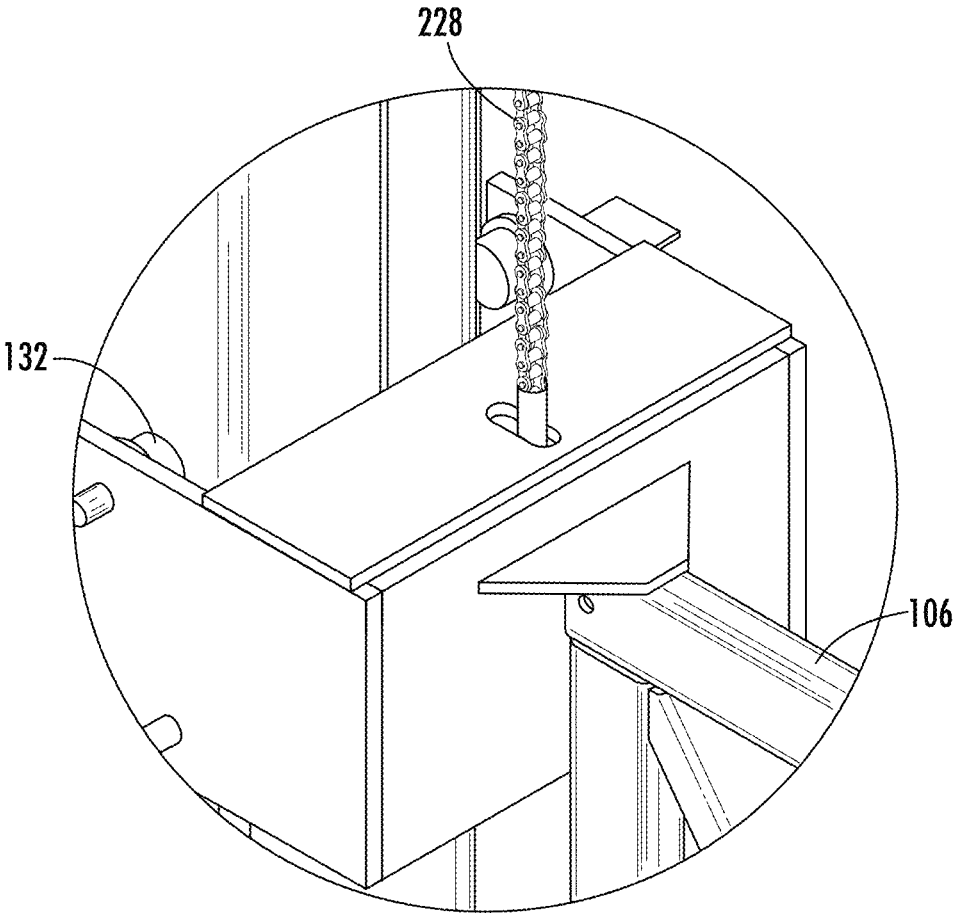
FIG. 9 is a fragmentary view of an attachment between a lifting chain and an elevating carriage for the elevating cage apparatus as in FIG. 2.

A coupling 232 couples drive shaft 220 to a drive shaft 234 (see also FIG. 8), which drives a similar system on an opposite side of the elevating cage. As one skilled in the art will understand, a sprocket receiving torque from drive shaft 234 pulls a chain that lifts a far side of the carriage. An opposite end of that chain similarly attaches to a second counterweight 218 that is suspended within corresponding column 102. In an embodiment, the combined weights of the first and second counterweights 218 is substantially the same as the weight of the carriage. A pair of housings (not shown) may be disposed at the upper ends of each column 102 to cover various drive components (e.g., bearings, sprockets, chains, belts, and drive shafts).

In an embodiment, motor 202 is operable by a remote control (not shown) which is in electrical communication with the motor. For example, depression of a first button on the remote control causes the motor to rotate in a first direction, thereby raising the carriage, and depression of a second button on the remote control causes the motor to rotate in a second direction, opposite the first direction, thereby lowering the carriage. In an embodiment, the remote control further includes an emergency stop button that, when depressed, decouples the power source from the motor, thereby stopping the carriage in place. The remote control may be located, for example, near the end of the gangway that is opposite to opening 116.

Figure 10:
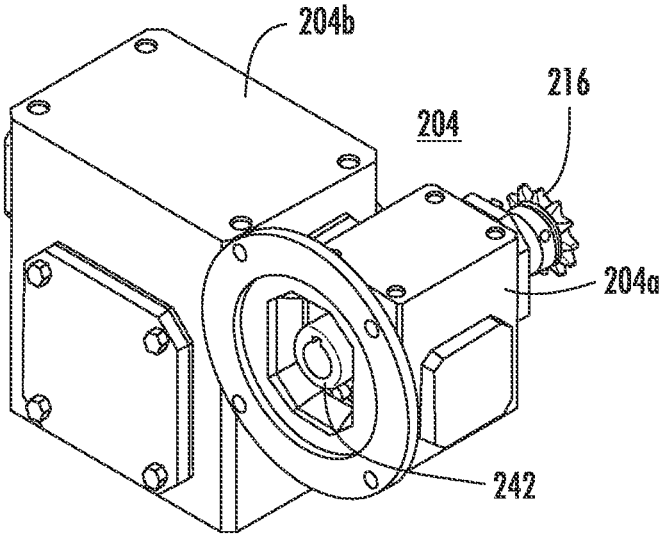
FIG. 10 is an isometric view of a gear box that may be used with the elevating cage apparatus as in FIG. 2.
Figure 11:
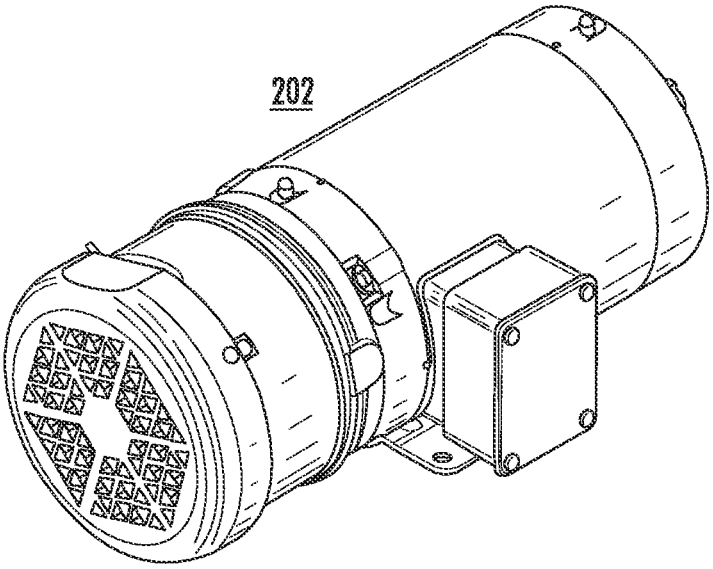
FIG. 11 is an isometric view of an electric motor that may be used with the elevating cage apparatus as in FIG. 2.
Figure 12:
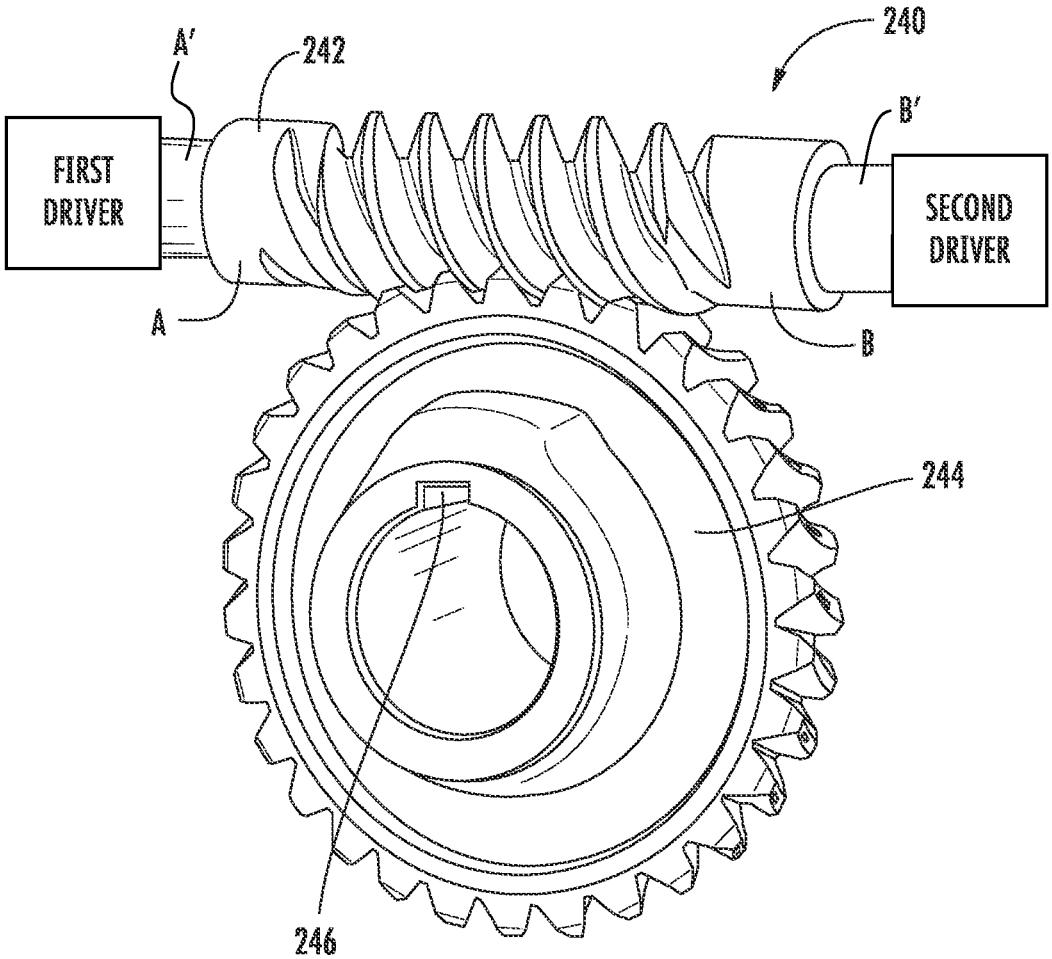
FIG. 12 is a perspective view of an exemplary worm and gear drive that may be incorporated into the gear box of FIG. 10.

FIG. 12 illustrates an example of a worm drive mechanism 240 that may be used in gear box 204. The respective ends A and B of the worm shaft 242 correspond to first and second inputs of the gear box 204 which, when rotated, causes rotation of a ring gear 244. The ring gear 244 is keyed (as at 246) to a shaft which in some embodiments can directly be the output shaft of the gear box 204. In the illustrated embodiment, however, that shaft serves as the input to a right angle transmission which facilitates the mounting of gear box 204. The output of the right angle transmission in such embodiments serves as the output shaft C (FIG. 4) of gear box 204. Thus, driven rotation of either the first input A or the second input B, such as via input shafts A' and B', causes rotation of the output shaft C. It will be appreciated that shaft A', worm shaft 242, and shaft B' form a continuous elongate assembly that rotates together when one of the inputs A and B is driven. Shaft 242 is located in portion 204*a* of the gear box 204, as shown in FIG. 10.

It can thus be seen that the present invention provides a novel elevating cage apparatus. While one or more preferred embodiments of the invention are described above, it should be appreciated by those skilled in the art that various modifications and variations can be made in the present invention without departing from the scope and spirit thereof. For example, while the illustrated embodiment includes a motor and a hand crank as the actuation means, other known power sources may be used, such as, for example, a high horsepower battery tool, or auxiliary electric motor. Accordingly, it should be understood that the elements of one embodiment may be combined with another embodiment to create a still further embodiment. It is intended that the present invention cover such modifications and variations as come within the scope and spirit of the present disclosure, the appended claims, and their equivalents.

The following is claimed:

1. An elevating cage apparatus for use in conjunction with a shipping container, said apparatus comprising:

a support structure;

a carriage coupled to the support structure so that the carriage is movable vertically with respect to the support structure when the support structure is in an upright position;

a gear box fixedly mounted with respect to the support structure so as not to move with the carriage having a first input and a second input either of which is operative to drive a shared output, the first input and the second input comprise opposite ends of a single shaft, wherein the gear box includes a worm drive and the single shaft comprises a worm shaft of the worm drive, the shared output being driven by the worm shaft and connected to the carriage to raise and lower the carriage;

a first driver in operative engagement with the first input of the gear box; and a second driver in operative engagement with the second input of the gear box.

2. The elevating cage apparatus as in claim 1, wherein the first driver comprises one of an electric motor, a hydraulic motor, and a pneumatic motor.

3. The elevating cage apparatus as in claim 1, wherein the second driver comprises a manual actuation mechanism having a hand crank.

4. The elevating cage apparatus of claim 1, wherein the gear box is configured to act as a brake to hold the carriage in place.

5. The elevating cage apparatus as in claim 1, wherein the carriage moves vertically along tracks extending vertically along the support structure.

6. The elevating cage apparatus as in claim 5, wherein the carriage moves along the tracks via a plurality of roller carriage assemblies.

7. The elevating cage apparatus as in claim 1, wherein the carriage extends from the support structure in a cantilevered configuration.

8. The elevating cage apparatus of claim 1, further comprising at least one counterweight that is configured to offset weight of the carriage.

9. The elevating cage apparatus of claim 1, wherein the carriage has a railing to form a cage.

10. An elevating cage apparatus comprising:

a support structure;

a carriage coupled to the support structure so that the carriage is movable vertically with respect to the support structure when the support structure is disposed in an upright position:

a gear assembly having:

an output shaft operatively coupled to the carriage so that rotation of the output shaft in one direction raises the carriage with respect to the support structure and rotation of the output shaft in an opposite direction lowers the carriage with respect to the support structure, a first input in rotationally driving engagement with the output shaft through the gear assembly; and a second input in rotationally driving engagement with the output shaft through the gear assembly;

wherein the first input and the second input comprise opposite ends of a single shaft, wherein the gear assembly includes a worm drive and the single shaft comprises a worm shaft of the worm drive, the output shaft being driven by the worm shaft;

wherein the output shaft, first input, and second input are fixedly mounted with respect to the support structure so as not to move with the carriage;

a first driver in rotationally driving engagement with the output shaft via the first input; and a second driver in rotationally driving engagement with the output shaft via the second input.

11. The elevating cage apparatus as in claim 10, wherein the first driver comprises one of an electric motor, a hydraulic motor, and a pneumatic motor.

12. The elevating cage apparatus as in claim 11, wherein the second driver comprises manual actuation mechanism having a hand crank.

13. The elevating cage apparatus as in claim 10, wherein the support structure comprises a pair of spaced apart columns and a cross member extending between upper ends of the columns.

14. The elevating cage apparatus of claim 10, further comprising at least one counterweight that is configured to offset weight of the carriage.

15. The elevating cage apparatus of claim 10, wherein the carriage has a railing to form a cage.

16. An elevating cage apparatus for use in conjunction with a shipping container, said apparatus comprising:

a support structure;

a carriage coupled to the support structure so that the carriage is movable vertically with respect to the support structure when the support structure is in an upright position, said carriage defining a railing structure about a periphery thereof;

a shared gear assembly having a first input, a second input, and a shared output shaft, the first input and the second input comprising opposite ends of a single shaft, wherein the gear assembly includes a worm drive and the single shaft comprises a worm shaft of the worm drive, the worm shaft being operative to rotate the shared output shaft, the shared output shaft being connected to the carriage to raise and lower the carriage, the first input, the second input, and the shared output shaft being fixedly mounted to the support structure so as not to move with the carriage;

a powered motor in operative engagement with the first input of the gear assembly; and a manual actuation mechanism in operative engagement with the second input of the gear assembly.

17. The elevating cage apparatus as in claim 16, wherein the manual actuation mechanism comprises a hand crank.

* * * * *